US005440104A

United States Patent [19]

Koch et al.

[11] Patent Number: 5,440,104

[45] Date of Patent: Aug. 8, 1995

[54] PROCESS FOR A UNIFORM HEATING, PASTEURIZATION AND STERILIZATION OF PRODUCTS BY MEANS OF MICROWAVE

[75] Inventors: Klaus Koch, Laatzen; Rolf Skubich, Langenhagen, both of Germany

[73] Assignee: Hermann Berstorff Maschinenbau GmbH, Hanover, Germany

[21] Appl. No.: 223,038

[22] Filed: Apr. 5, 1994

[30] Foreign Application Priority Data

Apr. 23, 1993 [DE] Germany ..... 43 13 275.8

[51] Int. Cl.[6] ..... H05B 6/78

[52] U.S. Cl. ..... 219/700; 219/702; 219/715; 99/325; 426/241

[58] Field of Search ..... 219/700, 701, 702, 715, 219/716, 718; 99/325, DIG. 14, 451; 426/241, 243

[56] References Cited

U.S. PATENT DOCUMENTS 4,142,082 2/1979 Israel ..... 219/715
4,296,296 10/1981 Eichelberger et al. ..... 219/715
4,593,167 6/1986 Nilssen ..... 219/715
4,825,028 4/1989 Smith ..... 219/716

*Primary Examiner*—Philip H. Leung
*Attorney, Agent, or Firm*—Foley & Lardner

[57] ABSTRACT

The invention relates to a process for a uniform and fast heating of products by microwaves that are pulsed and introduced intermittently into the products, with the products to be treated, such as chemical or pharmaceutical products or foodstuffs, particularly ready-cooked meals, being conveyed by a continuously working endless conveyor belt through a treatment chamber in open or closed microwave-permeable trays and with the treatment chamber being equipped with microwave generator supply channels that are arranged in a vertical or inclined position relative to the conveyor belt. The line is operated at a microwave power profile that shortens the build-up time and breaking time of the microwave pulses, at a working frequency of 50 kHz that has an edge steepness of 2 microseconds, and with pulses the amplitudes of which have a rectangular form and the length of which is in the microseconds or milliseconds region.

4 Claims, 1 Drawing Sheet

50/100 Hz 50 kHz

PROCESS FOR A UNIFORM HEATING, PASTEURIZATION AND STERILIZATION OF PRODUCTS BY MEANS OF MICROWAVE

BACKGROUND OF THE INVENTION

The invention relates to a process for uniform and fast heating of microwaves that are pulsed and introduced intermittently into the products which are conveyed through a treatment chamber in which the pulsed energy is supplied.

A process of this general kind is disclosed in U.S. Pat. No. 4,956,530, which discloses a treatment chamber, a continuous conveyor belt for conveying articles through the chamber, microwave input channels, and microwave generators for supplying microwave energy to the articles. U.S. Pat. No. 4,956,530 is hereby incorporated by reference for disclosure of those features, which per se form no part of the present invention.

By means of a pulsed and intermittent supply of the microwave energy required for increasing the temperature up to a certain level, it is ensured that the product surface is not excessively heated. The microwave power may assume various forms, with a rectangular form having the strongest effect on the product surface. Given a pulse-type operation of the line, however, trapezoidal and sinusoidal forms of power also lead to satisfactory results.

When lines that operate at 2,450 gigahertz are used, the long build-up time per pulse adversely influences the heating-up time, which means that relatively little energy can be introduced per energy supply pulse as a higher energy supply per pulse would damage the product surface.

A pulsed and intermittent introduction of energy into the products to be treated is expedient as the amount of microwave energy supplied (power×time) would otherwise be too high relative to the capacity of absorption of the product in a given length of time, thereby leading to an excessive and critical temperature increase at the product surface. If the energy supply is pulsed, microwave energy is repeatedly introduced into the product for a determined length of time.

SUMMARY OF THE INVENTION

The invention seeks to improve the pulsed introduction of microwave energy into the products to be treated. In particular, it aims at increasing the amount of energy absorbed by the product and reducing the time required for the absorption process, while at the same time increasing the power and thus the belt speed and the output of a continuously working line for heating, pasteurizing and sterilizing packed or unpacked foodstuffs and avoiding any critical overheating of the product surface. Consequently, the amount of energy that can be absorbed by the product can be increased in a given length of time without any damage.

This task is achieved by operating at a microwave power profile the build-up time and breaking time of the pulses, at a working frequency of 20 to 100 kHz, preferably 40 to 80 kHz, and more preferably 50 kHz, that has an edge steepness of 2 microseconds, and in which the amplitudes of the pulses are rectangular in form and the length of the pulses is in the microseconds or milliseconds region.

An energy pulse with an almost rectangular power profile is applied for rapidly heating the products. This leads to a considerable increase in the amount of energy absorbed without entailing any excessive temperature increase at the product surface.

It is thus possible to emit power pulses of 3 kW and a length of less than 5 microseconds which carry an amount of energy of E min$\leqq \times 10^{-2}$ Ws with a 2.5 fold rectangular power profile.

As the electronic control systems that are currently in use constitute analog systems, it is impossible to obtain leading edges of less than t(a)$\geqq$80 to 200 milliseconds when switching on the power. This causes substantial difficulties when energy is to be introduced into a product contained in a package that has a length of less than 80 mm and is conveyed at a speed of v$\geqq$6 m/min within the available time of $t_{max}\leqq$800 milliseconds. A minimum pulse time of less than 100 milliseconds allows to more than double the conveying speed that was permissible so far under the most favorable conditions.

In order to ensure that the process according to the invention allows the required throughput of m>2 500 kg to be obtained without encountering constructional or process-technical limits (line width, conveying speed), it is expedient to use the faster system according to the invention. This system not only ensures short build-up times but also a more precise pulse form with a considerably higher efficiency.

The application of extremely short pulses with high power levels has proved to be of decisive importance when treating foodstuffs, for instance. If instead of the 100 Hz pulse system, the frequency of which allows an edge steepness of the power pulse in the region of a few microseconds, a 50 kHz pulse system is used, power pulses with a defined rectangular form and a length of at least 1 millisecond can be obtained without there being any upper time limit. In this manner, the advantages offered by the operation of microwave generators (magnetrons) controlled in the described way can be profitably used. These advantages are as follows:

1. The power supplied by the magnetron per pulse may exceed the rated power output at continuous current many times over, provided that the mean power is not higher than the rated power.

2. The precise rectangular form of the power pulse ensures that the total power is available for heating the product as soon as the power has been switched on.

3. Given a pulse length in the region of milliseconds, power pulses of such a form surprisingly lead to an increased depth of penetration of the energy supplied and a faster heating of the product, reducing at the same time the temperature gradient in direction of penetration.

4. Relatively little energy is converted at the product surface, thus reducing the risk of overheating in this area.

5. By increasing the steepness of the leading edges, the product to be treated can be conveyed at a higher speed without the product surface becoming critically overheated (full power supply during millisecond pulses).

BRIEF DESCRIPTION OF THE DRAWINGS

The invention will be explained below on the basis of the drawings, in which.

DETAILED DESCRIPTION OF THE PREFERRED EMBODIMENTS

The fundamental difference between the 100 Hz pulse system of the prior art and the 50 kHz pulse system according to the present invention can best be illustrated by comparing FIGS. 1 and 2, and FIGS. 3 and 4.

Figure 1:
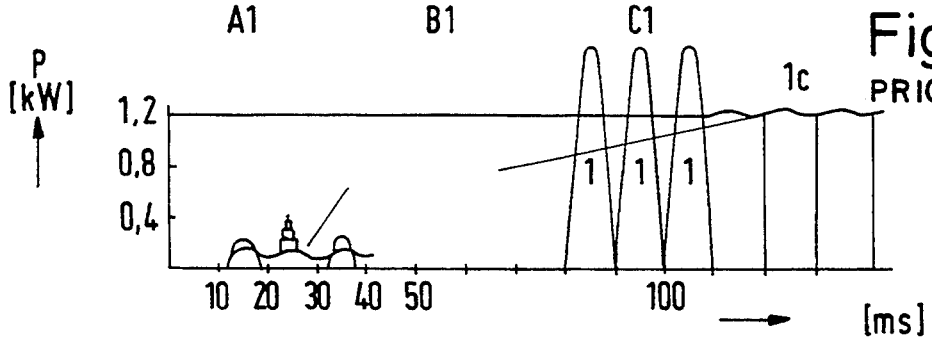
Fig.1 PRIOR ART
FIG. 1 and FIG. 3 illustrate the 100 Hz pulse system according to the state of the art.

In the 100 Hz pulse system of FIG. 1, after integrating and electronically controlled rectification (100 Hz), the 50–100 Hz power frequency pulses (1) rectified by a bridge rectifier have a relatively flat leading edge and residual ripple (after electric smoothing).

Figure 2:
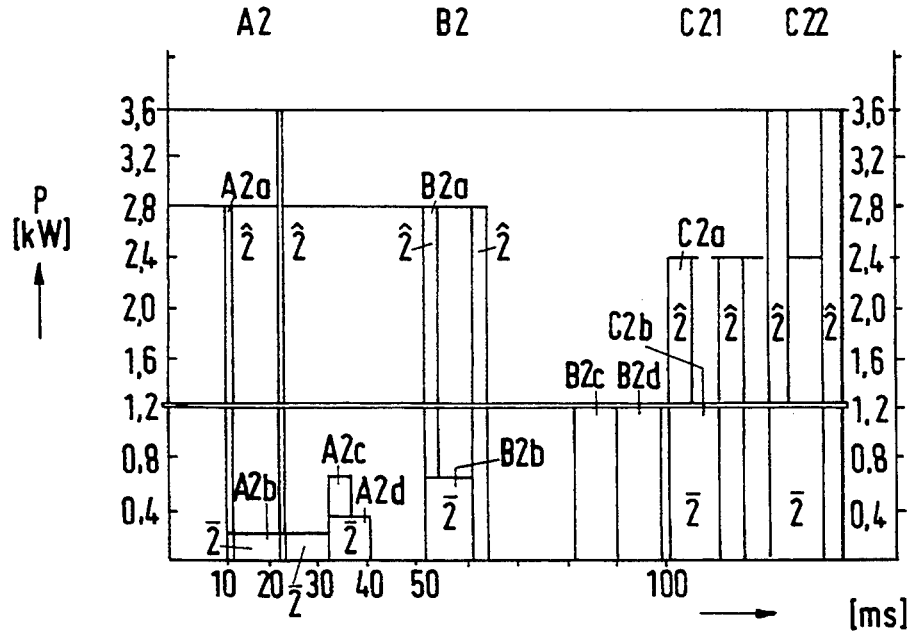
FIG. 2 and FIG. 4 illustrate the 50 kHz pulse system according to the invention.

By way of contrast, as a result of the 50 kHz high frequency pulse system of FIG. 2, the pulses 2, which are equivalent to the pulses 1, assume an almost ideal rectangular form with a rectangular pulse amplitude (A2*a*, B2*a*, C2*a*) when plotted against the time factor (abscissa). Due to this rectangular pulse form, it is possible to select a threefold to fourfold rated power at continuous current, provided that this power overamplification is limited to 50 to 80 milliseconds at the maximum and followed by a pulse break during which the mean power does not exceed the rated power of 1.2 kW (in this case) (A2*b*, B2*b*, C2*b*).

Figure 3:
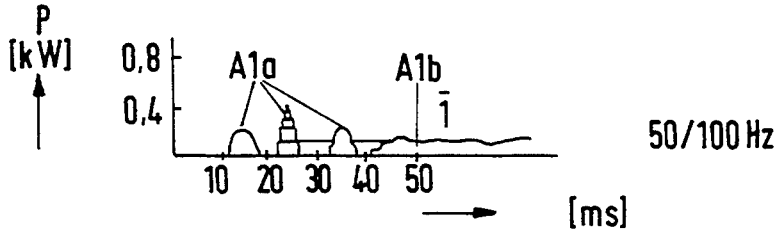
Fig. 3 PRIOR ART

Referring new to the 100 Hz pulse system of the prior art as show in FIG. 3, after conclusion of the integrating power control, the more or less regular pulses 1 (A1*a*) produce a wavy constant power with a flat leading edge.

Figure 4:
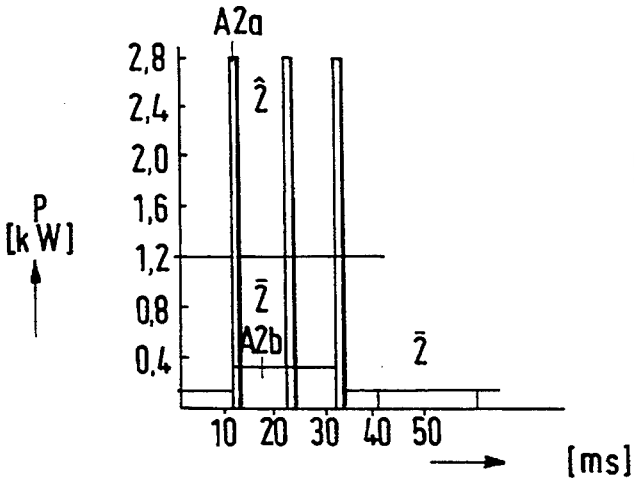

Again by way of contrast, when using short power pulses (A2*a*) in the 50 kHz pulse system according to the invention and shown in FIG. 4, a high amount of power can be introduced into the product without running the risk of overheating it. It is also possible, however, to use the same amount of energy ($P \times t$) as a low constant power of rectangular form (steep pulse edges, amplitude ripple A2*b*). The same power form as in FIG. 3, A1*b*, can also be used, however, without the undesirable ripple (2).

It is claimed:

1. A method of a uniform and fast heating of products by means of microwaves that are pulsed and introduced intermittently into the products, with chemical and pharmaceutical products and ready-cooked meals to be treated being conveyed by a continuously working conveying system through a treatment chamber in open or closed microwave-permeable trays and with the treatment chamber being equipped with microwave generator supply channels that are arranged in a vertical or inclined position relative to the conveyor belt and whose energy supply is pulsed and can be controlled by means of a computer, comprising the step of:

providing power pulses generated by a working frequency within a range of 20 to 100 kHz, having an edge steepness of below 1 millisecond, and having an amplitude which is greater than a rated power of actuated microwave generators, wherein a mean power does not exceed the rated power due to allocation of corresponding pulse breaks, and the length of said pulse breaks depends on the power overamplification.

2. The method of claim 1, wherein said working frequency is 40 to 80 kHz.

3. The method of claim 2, wherein said working frequency is 50 kHz.

4. A method of a uniform and fast heating of products by means of microwaves that are pulsed and introduced intermittently into the products, with chemical and pharmaceutical products and ready-cooked meals to be treated being conveyed by a continuously working conveying system through a treatment chamber in open or closed microwave-permeable trays and with the treatment chamber being equipped with microwave generator supply channels that are arranged in a vertical or inclined position relative to the conveyor belt and whose energy supply is pulsed and can be controlled by means of a computer, comprising the step of:

providing power pulses generated by a working frequency within a range of 20 to 100 kHz, having an edge steepness of below 2 microseconds, and having an amplitude which is greater than a rated power of actuated microwave generators, wherein a mean power does not exceed the rated power due to allocation of corresponding pulse breaks, and the length of said pulse breaks depends on the power overamplification.

* * * * *